US005337036A

United States Patent [19]

Kuczynski

[11] Patent Number: 5,337,036

[45] Date of Patent: Aug. 9, 1994

[54] MINIATURIZED THERMAL PROTECTOR WITH PRECALIBRATED AUTOMATIC RESETTING BIMETALLIC ASSEMBLY

[76] Inventor: Robert A. Kuczynski, 520 Springfield Ave., Westfield, N.J. 07090

[21] Appl. No.: 98,960

[22] Filed: Jul. 28, 1993

[51] Int. Cl.[5] ..... H01H 37/44

[52] U.S. Cl. ..... 337/343; 337/365

[58] Field of Search ..... 337/342, 343, 102, 107, 337/365

[56] References Cited

U.S. PATENT DOCUMENTS

| | | | |
|---|---|---|---|
| 3,294,940 | 12/1966 | Ulanet . | |
| 3,322,920 | 5/1967 | Morris | 337/365 |
| 3,537,052 | 10/1970 | Snider | 337/354 |
| 3,700,969 | 10/1972 | Furnival . | |
| 3,715,697 | 2/1973 | Them | 337/157 |
| 3,827,013 | 7/1974 | Kowalski et al. | 337/354 |
| 4,295,114 | 10/1981 | Pohl | 337/3 |
| 4,490,704 | 12/1984 | Snider et al. | 337/372 |
| 4,528,541 | 6/1985 | Hollweck et al. | 337/342 |
| 4,775,787 | 10/1988 | Ushiyama . | |
| 4,862,133 | 8/1988 | Tabei | 337/365 |
| 4,876,523 | 10/1989 | Kushida et al. | 337/299 |
| 5,014,034 | 5/1991 | Wehl | 337/368 |
| 5,121,095 | 6/1992 | Ubukata et al. | 337/365 |
| 5,233,325 | 8/1993 | Takeda | 337/102 |

OTHER PUBLICATIONS

Texas Instruments Brochure 34–8099A (Jul. 1988) 7AM Thermal Protectors.

*Primary Examiner*—Lincoln Donovan

*Attorney, Agent, or Firm*—Lerner, David, Littenberg, Krumholz & Mentlik

[57] ABSTRACT

A thermal protector for protecting an electrical accessory in a current carrying circuit is actuated when abnormal changes occur for any reason in the ambient temperature about the accessory has, a conductive first terminal defining a stationary contact and is connected to one side of the current carrying circuit, an insulator coacts with the first terminal for isolating the first terminal except for the stationary contact thereon from the other conductive elements of the thermal protector, a conductive actuating assembly having a leaf spring formed thereon and a contact fixedly connected and movable with the leaf spring is aligned for engagement and disengagement with said stationary contact, a second conductive terminal member is connected to the opposite side of said current carrying circuit and has a connector assembly for joining the first conductive terminal, the conductive actuating assembly and the second conductive terminal member to each other, a bimetallic element freely positioned in the thermal protector for operative engagement with the leaf spring actuates the leaf spring responsive to the abnormal changes in the said ambient temperature about the accessory to cause the contact thereon to engage and disengage the stationary contact for opening and closing the current carrying circuit for the electrical accessory to be protected.

15 Claims, 5 Drawing Sheets

FIG. 20
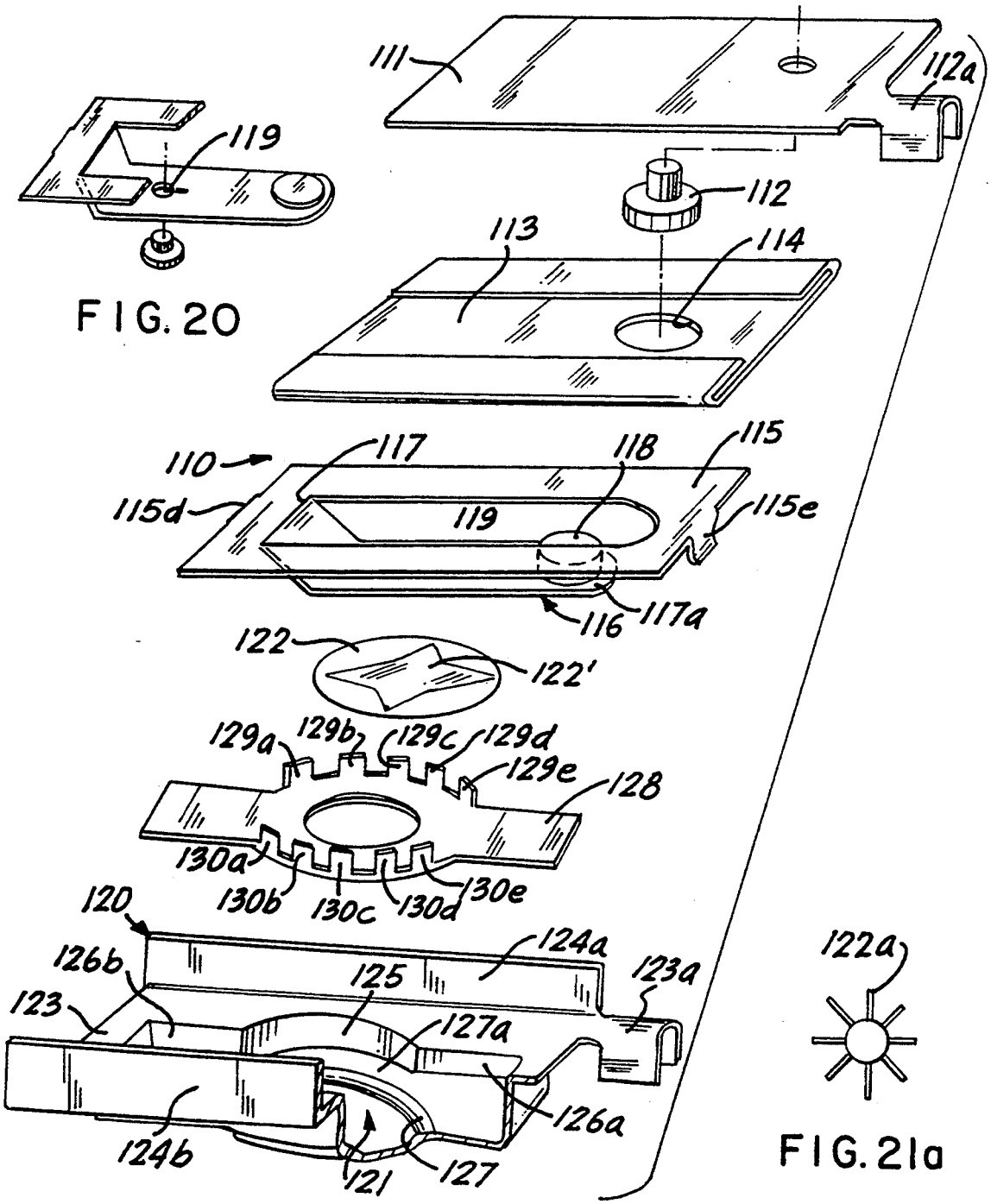
FIG. 19
FIG. 21a
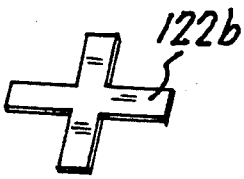
FIG. 21b
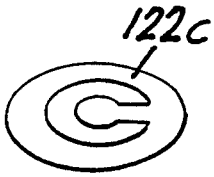
FIG. 21c
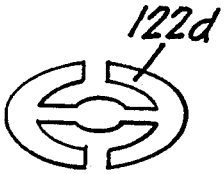
FIG. 21d
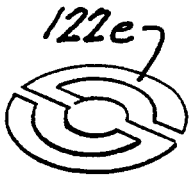
FIG. 21e

MINIATURIZED THERMAL PROTECTOR WITH PRECALIBRATED AUTOMATIC RESETTING BIMETALLIC ASSEMBLY

BACKGROUND OF THE INVENTION

This invention relates generally to thermal protectors for current carrying circuits such as miniature thermostats, miniature circuit breakers and the like using bimetallic actuating assemblies and more particularly to a miniature thermal protector with a precalibrated automatic resetting bimetallic actuating assembly adapted for various applications, equipment and uses which require protection against abnormal changes in ambient temperature.

Valuable equipment and assemblies such as motors of various types, equipment with motors therein such as vacuum cleaners, automotive accessories, florescent lighting and HID ballasts, lighting fixtures, and other equipment and assemblies including, solenoids and PC boards and the like, require protection against overheating and against abnormal changes in the ambient temperature for any reason at the location where the equipment or assemblies are in operation.

Miniature thermostats using bimetallic actuating assemblies in which the current passing through the thermostat also passes through the bimetallic element are presently known and available in the commercial marketplace, for this purpose, such as the TI 7AM Thermal Protector manufactured and sold by Texas Instruments Incorporated.

These known thermal protectors are characterized by the fact that the bimetallic elements are affixed or attached in the bimetallic assemblies by welding to one of the terminals of the current carrying circuit and cantilevered so that a contact, also generally welded to the bimetallic element at the end remote from the welded or affixed end, is adapted under the conventional snap acting operation of the bimetallic element to move into and out of engagement with a stationary contact on the opposite terminal of the current carrying circuit.

In these miniature thermostats, an insulating material is sandwiched between the bimetallic element and the terminal carrying the stationary contact to enable these thermostats to be manufactured or fabricated in the smallest possible size and with the least number of parts so they can be manufactured and assembled on modern production equipment, accurately and cheaply and in quantities to meet the increasing commercial demand for such protective devices.

However, these known thermal protectors develop production problems because of the various stresses which are likely to occur, first, during the welding or affixing of the contact to the bimetallic element, and second, during the welding or affixing of the bimetallic element into assembled position in the thermal protector.

To overcome this problem, the manufacturers of the known thermal protectors recalibrate the bimetallic element and/or the bimetallic assembly in an effort to reset the thermal protector so they operate within the specified temperature rating for each particular size, current operating parameters and other limitations for the given thermal protector. However, even this recalibration technique does not achieve the desired accuracy required in the commercial marketplace.

The thermal protectors in accordance with the present invention overcome these production and other problems by providing an improved structure and operation such that the current in the current carrying circuit in which the thermal protector is connected does not flow through the bimetallic element. Further, the bimetallic element which is freely positioned in the thermal protector is operatively associated with and actuates an assembly having a contact movable therewith for coaction with a fixed contact to open and close the circuit to control the current passing through the thermal protector. This structure and operation eliminates the contact on the bimetallic element and the requirement for welding the bimetallic element into assembled position, and this eliminates the sources for the above mentioned prior art production problems.

In addition to overcoming the prior art production problems, the improved structure and operation for a thermal protector in accordance with the present invention also permits a wide range of actuating temperatures. First, because of the large number of variations for the bimetallic element which can now be achieved through the selection of the materials, the thickness, the shape and the curvature for the bimetallic element. Second, because the elements of the actuating assembly also can be modified through the selection of materials, thickness, width and length. Third, because of the operative coaction which can be obtained between the bimetallic element and the actuating assembly. Fourth, where the thermal protector cannot be further miniaturized, it permits the addition of a heater to achieve the predetermined actuating temperature for the bimetallic element. And last, when the parts and elements of the thermal protector in accordance with the present invention are assembled for operative relation with each other, they are automatically and accurately positioned for the required interrelationship between the bimetallic element and the leaf spring on the intermediate actuating element to achieve operation within the predetermined parameters for the given thermal protector, all of which will be more fully described below.

SUMMARY AND OBJECTS OF THE INVENTION

Thus, the present invention covers an improved thermal protector for use in a a current carrying circuit having, a first conductive terminal defining a stationary contact connected to one side of the current carrying circuit, insulator means for isolating the first conductive terminal except for the stationary contact from the opposite side of the current carrying circuit, a conductive intermediate element having a movable resilient means with at least one free end, contact means connected to and movable with the free end of said resilient means and disposed for operative association with the stationary contact to open and close the current carrying circuit, a second conductive terminal having means for fixedly connecting into assembled relation the first conductive terminal and its operatively associated insulator member, the intermediate element and the second conductive terminal, a precalibrated bimetallic element freely positioned in the thermal protector for snap action at a predetermined temperature, and said bimetallic element operative for non-conductive engagement with the resilient means responsive to abnormal changes in the ambient temperature to bring the movable contact into and out of engagement with the stationary contact during operation of the bimetallic element.

Accordingly, it is an object of the present invention to provide an improved thermal protector for a current carrying circuit adapted to handle low to very high current ratings having a bimetallic actuating element calibrated to operate at a predetermined temperature which does not serve as a conductor for the current flowing through the thermal protector and actuates the thermal protector responsive to abnormal changes in the ambient temperature.

Other objects and advantages will become apparent from the following detailed descriptions of various embodiments of the invention taken in conjunction with the accompanying drawings.

DESCRIPTION OF THE FIGURES OF THE DRAWINGS

FIG. 19 is an exploded view of another form of thermal protector in accordance with the present invention including, an insulated element for isolating the bimetallic plate or element from the current carrying circuit and for holding the bimetallic element in assembled position, FIG. 20 is a perspective view of the leaf spring for the intermediate element showing another means for assembling an insulated fulcrum member thereon, FIG. 21*a* shows a plan view of another form of insulating paper or other material for affixing to the coacting face of the bimetallic member disposed for operative coaction with the insulated pivot button, FIG. 21*b* shows a plan view of another form of insulating paper, FIG. 21*c* shows another form of insulating paper, FIG. 21*d* shows another form of insulating paper, FIG. 21*e* shows still another form of insulating paper.

DESCRIPTION OF A FIRST EMBODIMENT OF THE INVENTION

Figure 1:
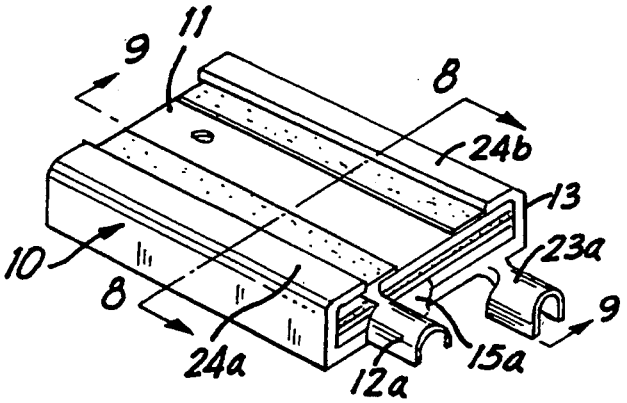
FIG. 1 is a top perspective plan view of one form of thermal protector in accordance with the present invention.
Figure 2:
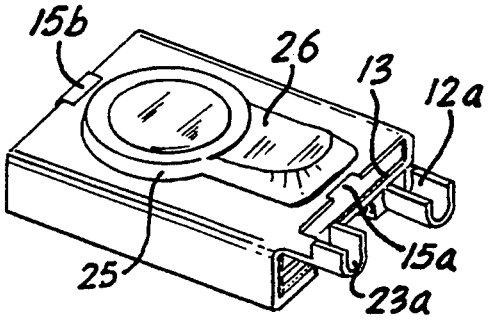
FIG. 2 is a bottom perspective plan view of the thermal protector shown in FIG. 1.
Figure 3:
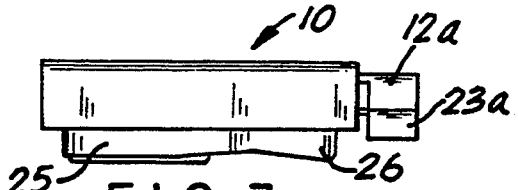
FIG. 3 is a left side view of the thermal protector shown in FIG. 1.
Figure 4:
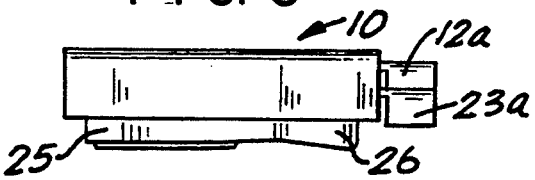
FIG. 4 is a right side view of the thermal protector shown in FIG. 1.
Figure 5:
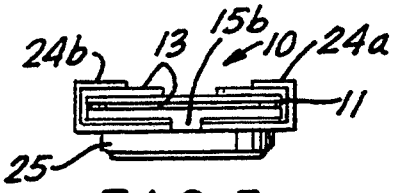
FIG. 5 is a left end view of the thermal protector shown in FIG. 1.
Figure 6:
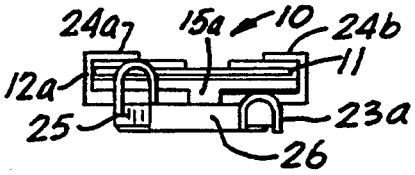
FIG. 6 is a right end view of the thermal protector shown in FIG. 1.

Referring to the drawings, FIGS. 1 to 18 show one embodiment of the thermal protector in accordance with the present invention in the form of a miniature thermostat generally designated 10 for protecting a given piece of equipment or accessory due to abnormal changes in the ambient temperature. Thermostat 10 is rectangular in plan view, having a length greater than its width. Those skilled in the art will readily recognize that the shape and size of the thermostat 10 is merely for purposes of illustration and that the thermostat 10 may have any other shape or size as may be required or desirable for a given application without departing from the scope of the present invention.

By further reference, more particularly to FIGS. 7, 8, 9 and 10, thermostat 10 is shown to include, a conductive first or upper terminal plate 11 having a stationary contact 12 on the under or inner surface and a first connector 12*a* for connecting the first upper terminal plate 11 to the current carrying circuit for the equipment or accessory being protected by the thermostat.

Upper terminal plate 11 may be fabricated as by drawing, stamping, molding, etc. from any suitable type of conductive material such as a copper alloy or preferably a steel alloy because it is stronger and cheaper to use for this purpose.

Operatively associated with the upper terminal plate 11 is an insulator element 13. The insulator element 13 will fully cover the inner or under surface of the upper terminal plate 11 and has a sized opening 14 therein so that in assembled position the insulator element 13 serves to isolate the upper terminal plate 11 from the remaining current carrying elements of thermostat 10 except for the stationary contact 12 which extends through the sized opening 14 for operative association with the other elements of the thermostat 10 in the current carrying circuit.

In order to make operative contact with the stationary contact 12, an intermediate member 15 has a centrally disposed leaf spring 16 formed or struck thereon with one end fixed as at 17 so that the free end as at 17*a* is movable relative the fixed end 17. Fixedly connected and movable with the free end 17*a* is a contact 18, and the leaf spring 16 is struck or otherwise formed to provide a fulcrum member 19 which is disposed a spaced distance medially along the leaf spring 16 between the fixed end 17 and the movable end 17*a* to increase the lifting movement of the leaf spring during the operation of the thermostat 10 as hereinafter described. Leaf spring 16 will also be bent and shaped so that it lies below the horizontal plane of the intermediate member 15 to also increase the distance the leaf spring can be moved in assembled position for improved consistent and accurate operation of the thermostat 10. This additional space is achieved as is explained more fully below. Thus, whenever the leaf spring 16 is actuated to move about the fixed end 17, movable contact 18 will be brought into engagement and will make contact with the stationary contact 12 on the upper terminal plate.

In this form of the invention, the intermediate member 15 and/or the leaf spring 16 are shaped and made of materials to provide low resistance to the current passing through the thermostat 10 so as to avoid generating heat in the thermostat. Thus, the intermediate member 15 and the leaf spring 16 will be made of materials which have a low resistance to current flow such as beryllium copper alloy. The shape, size and thickness of the intermediate member 15 and the leaf spring 16 also can be varied to achieve the desired resistance to current flow. Thus, increasing the thickness and/or the width of the leaf spring 16 will reduce resistance to current flow through the thermostat 10.

FIGS. 7, 8, 9, 10, 11, 12, 13, 14 and 15 illustrate one form of intermediate member 15 and leaf spring member 16 for the form of the invention shown in FIGS. 1 to 18 of the drawing.

Figure 22A:
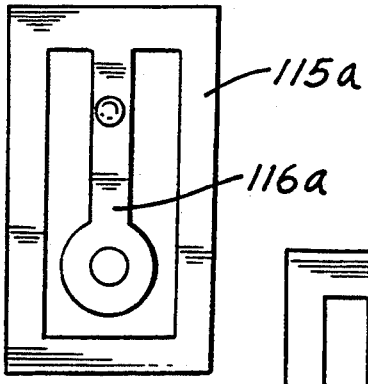
FIG. 22*a* shows another form for the intermediate member to establish high resistance to the current flow in the current carrying circuit in which the thermal protector is connected.
Figure 22B:
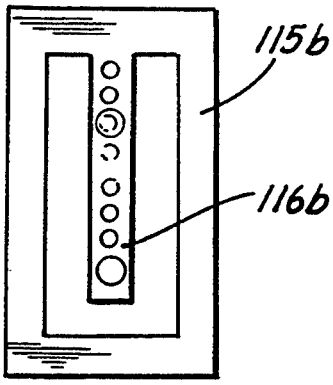
FIG. 22*b* is still another form for the intermediate member.

FIGS. 22*a* and 22*b* show variations of the intermediate members 115*a* and 115*b* and the leaf spring 116*a* and 116*b*. FIGS. 22*a* and 22*b* show the leaf spring 116*a* or 116*b* modified so that it is narrow. This structure will increase the resistance of the intermediate member 115*a* and 115*b* to the current flow through thermostat 10. Where resistance is increased, heat is added to the thermostat 10. In certain applications it may be desirable to add heat where higher operating temperatures for the bimetallic element are necessary or desirable or where current sensing capabilities must be incorporated.

Figure 22C:
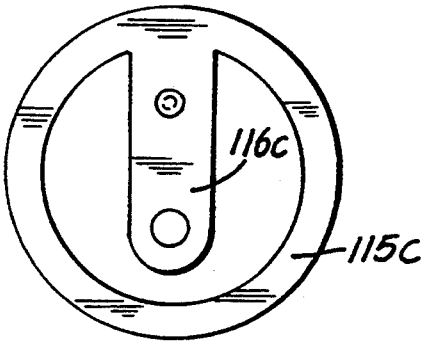
FIG. 22*c* is still an alternate form for a different shaped intermediate member for a thermal protector.

FIG. 22*c* shows a still further alternate form of the intermediate member 115*c* and leaf spring 116*c* where the thermostat has a circular configuration in plan view rather than the illustrated rectangular form in plan view of the embodiment of the invention shown at FIGS. 1 to 18 of the drawings and at FIGS. 22*a* and 22*b*.

It is, however, clear that the materials, the size, the shape and the thickness of the intermediate member 15 and the leaf spring 16 can be varied so as to avoid adding heat to the Thermostat 10 or to add heat as a function of the amperage in the current carrying circuit depending on the desired operating parameters required for a given thermostat or thermal protector in accordance with the present invention.

A second, lower or base terminal plate 20 also made of any suitable conductive material such as copper alloy or preferably steel is fabricated by striking, drawing or molding, plate or sheet material to a size and shape to permit the lower terminal plate to lock the upper terminal plate 11, its associated insulator element 13, intermediate member 16 and the lower or base terminal 20 to each other. When so joined, a space or chamber generally designated 21 is formed between the lower terminal plate 20 and the intermediate member 17. Before the said elements are so joined, a calibrated bimetallic element 22 can be freely located in the space or chamber 21 for operative association with the leaf spring 16 on the intermediate member 15.

In order to join these elements, second, lower or base terminal plate 20 will have a generally horizontal section 23 having a second connector 23*a* for connecting the thermostat 10 into the current carrying circuit of the equipment or accessory being protected by thermostat 10 and spaced vertical sections as at 24*a* and 24*b* which are connected to opposite sides of horizontal section 23. The inner face of horizontal section 23 and the spaced distance between the vertical sections 24*a* and 24*b* are so shaped and sized that the upper terminal plate 11, its associated insulator element 13 and the intermediate member 15 can be nested and locked into assembled position after a bimetallic element 22 is freely positioned or located in the space or chamber 21.

The elements of the thermostat 10 are joined or locked together by bending the vertical sections 24*a* and 24*b* about all the elements until they are connected together in the shape and form as shown in FIGS. 1 to 6 of the drawings.

Figure 9:
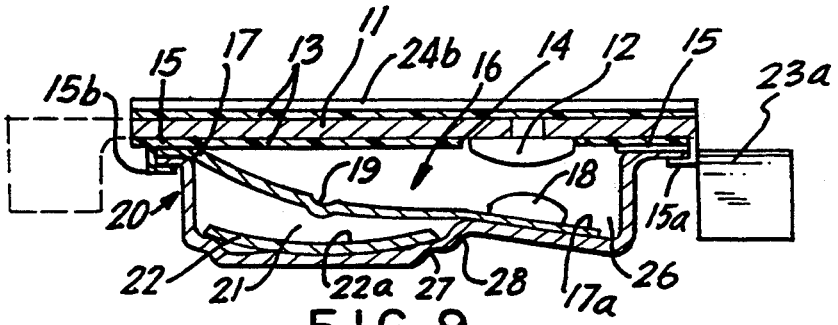
FIG. 9 is a longitudinal cross-section taken on line 9—9 of FIG. 1, with the bimetallic plate and the coacting contacts in the normally open position.
Figure 10:
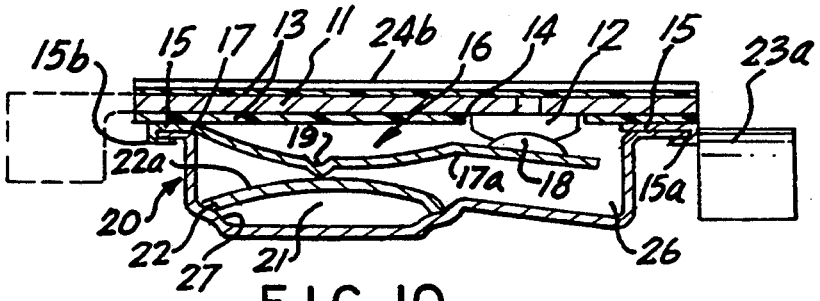
FIG. 10 is the same longitudinal cross-section shown in FIG. 9 with the bimetallic plate and the coacting contacts in a normally closed position.

The first connector 12*a* on the first or upper terminal plate 12 or the second connector 23*a* on the horizontal section 23 of the second, lower or base terminal plate 20 can be positioned at either end of the first or upper terminal plate 12 or the horizontal section 23 of the second lower or base terminal plate 23 as is shown by the phantomized lines at FIGS. 9 and 10 of the drawings.

Referring to FIGS. 7 to 10 of the drawings, the inner face of the horizontal section 23 of the second, lower or base terminal plate 20 is shown as having a predetermined shaped indented portion which in part defines the bimetallic chamber or space 21. The bimetallic chamber or space 21 has a generally circular section 25 and a side or laterally extending section 26 continuous therewith. The circular section 25 and side section 26 are so struck, formed or molded that in assembled position this circular section 25 of the chamber on space 21 and side section 26 lie below the plane of the horizontal section 23 of the second, lower or base terminal plate 20. Side section 26 slopes down from the circular section 25 so as to increase the inside clearance for the leaf spring 16 to enable the leaf spring to obtain as much lift as possible during the operation of the thermostat 10. This is important particularly in the miniaturized form of the thermal protectors in order to obtain consistent and accurate operation of such miniaturized thermal protectors particularly with respect to the pressure that will be exerted between the movable and stationary contact during such operation.

The circular section 25 of the chamber or space 21 is wider in diameter than the width of the side section 26 and provides an annular shoulder 27 which is inwardly of the rim of the circular section 25. Further, about the rim of the circular section 25 where it meets the associated side section 26, a beveled edge 27 is provided. This construction permits the bimetallic element 22 to be freely positioned or located in the bimetallic chamber or space 21 in the second, lower or base terminal 20 before the elements are assembled as above described.

Bimetallic element 22 can be positioned either as shown in FIG. 9, with the convex side up when normally open operation is desired with respect to the current carrying circuit for the accessory, not shown, to be protected or as shown in FIG. 10, with the convex side down when normally closed operation with respect to the current carrying circuit for the accessory, not shown, to be protected is desired.

In assembled position in thermostat 10, intermediate member 15 is so positioned between the conductive first upper terminal plate 11, its operatively associated insulator element 13 and the conductive second lower or base terminal plate 20 that the movable contact 18 on leaf spring 16 is in alignment for movement into and out of engagement with the stationary contact 12. Thus, on movement of the leaf spring 16, the movable contact 18 will act to open and close the current carrying circuit for the equipment or assemblies protected by the thermostat 10 in any given application.

Intermediate member 15 is shown as generally rectangular in plan view so as to match and fit the underside or inner surface of the upper terminal plate 11. The centrally disposed leaf spring 16 in this assembled position will be struck, bent or formed so that the contact 18 movable therewith lies below the horizontal plane of the intermediate member 15.

Further, when the intermediate member 15 is in assembled position, the fulcrum member 19 is disposed for contact and coaction with bimetallic plate or element 22 freely positioned or located in the conductive, lower or base terminal plate 20, as is shown in FIGS. 7, 8, 9 and 10 of the drawings.

The fulcrum member 19 may just be in the form of a dimple struck in the upper surface of the leaf spring 16*a*, as shown in FIGS. 1 to 15 of the drawings, or it may be a separate member which is connected to the leaf spring 16 as shown and described below for the form of the invention shown in FIG. 19 of the drawings. However, fulcrum member 19 is preferably spaced and positioned along the leaf spring 16 for accurate contact with the central or medial point on the coacting bimetallic plate or element 22. The fulcrum member 19 acts as an additional lifter, and a greater amount of travel of the leaf spring 16 will be obtained if the fulcrum member 19, of whatever type it may be, contacts this central or medial point of the bimetallic plate or element 22. The preferable location for the fulcrum member 19 will be for contact with the exact dead center of the metallic plate or element 22.

The moment of force exerted on the leaf spring 16 through the coaction of the bimetallic plate or element 22 and the fulcrum member 19 will decrease or increase the pressure between the movable contact 18 and the stationary contact 12 during the operation of thermostat 10.

This contact pressure between the movable contact 18 and the stationary contact 12 is important to consistent, regular and continuous operation of thermostat 10. If the contact pressure is too light or inadequate, the contacts will chatter and arc, causing increased erosion of the contact surfaces and diminish the life of the contacts. Conversely, if the contact pressure is too great, the contacts will not open or will not open properly, and the operation of the thermostat 10 will be inconsistent or may fail.

Figure 7:
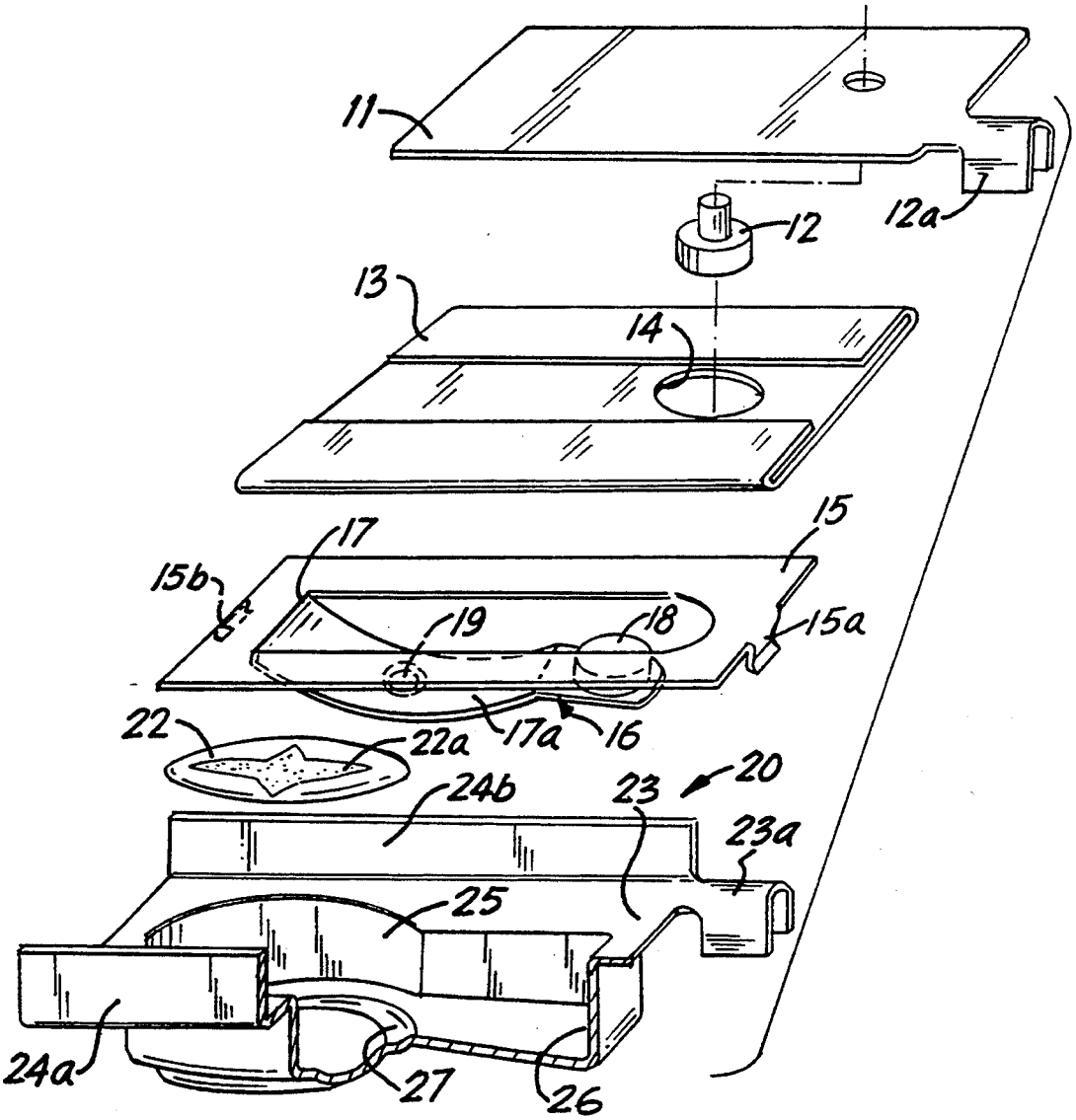
FIG. 7 is an exploded generally perspective view partly in vertical section of the thermal protector shown in FIG. 1.
Figure 8:
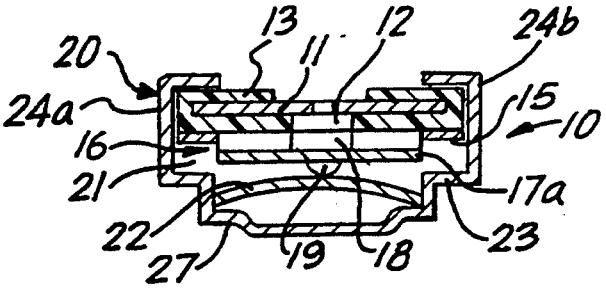
FIG. 8 is a transverse cross-section taken on line 8—8 of FIG. 1.
Figure 11:
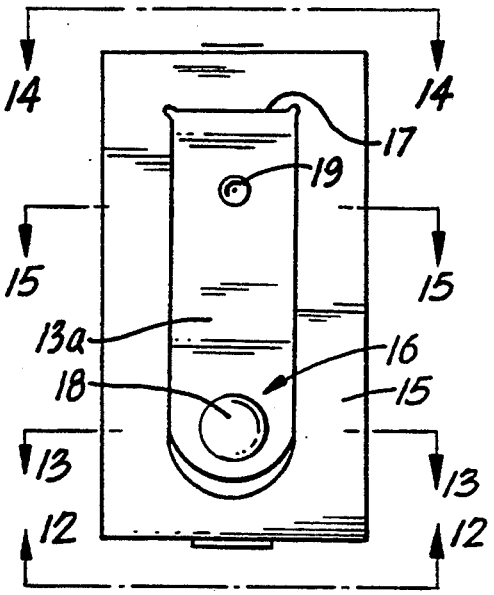
FIG. 11 is an enlarged top plan view of the intermediate element for the thermal protector shown in FIG. 1 having the central leaf spring with the movable contact and one form of fulcrum member for operative association with the bimetallic element.
Figure 16:
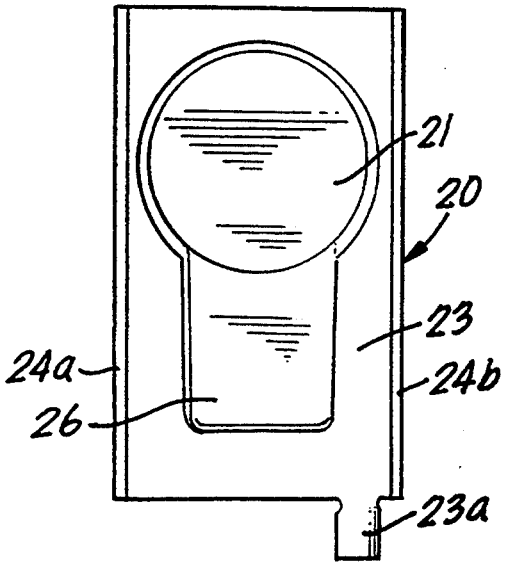
FIG. 16 is a top plan view of the second or lower terminal plate of the thermal protector shown in FIG. 1.
Figure 12:
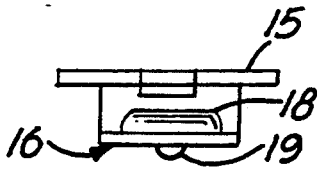
FIG. 12 is a front end view of the intermediate element shown in FIG. 11.
Figure 13:
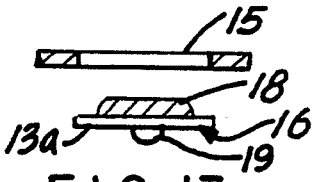
FIG. 13 is a cross-section taken on line 13—13 of FIG. 11.
Figure 17:
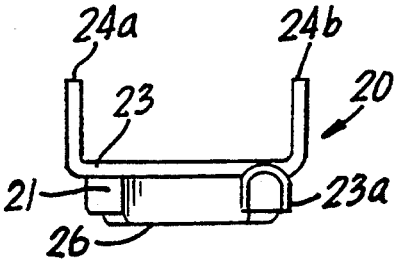
FIG. 17 is a front view of the second or lower terminal plate shown in FIG. 16.
Figure 14:
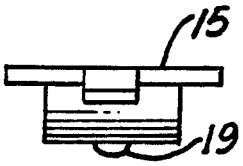
FIG. 14 is a back view of the intermediate element shown in FIG. 11.
Figure 18:
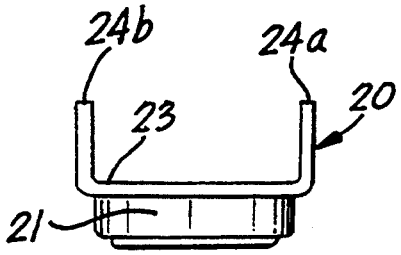
FIG. 18 is a back view of the second or lower terminal plate shown in FIG. 16.
Figure 15:
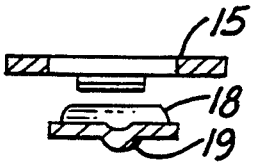
FIG. 15 is a cross-section taken on line 15—15 of FIG. 11.

In order to insure that during operation the coacting surfaces of the fulcrum member 19 and the center section of the bimetallic plate or element 21 do not erode, wear or undergo some physical changes that may bring the bimetallic plate or element 22 into the current carrying circuit, the coacting center section of the bimetallic plate or element 22 is covered with an insulator as at 22*a*, shown at FIG. 7, and other forms of which are shown at 122*a* at FIG. 21*a*; 122*b* at FIG. 22*b*; 122*c* at FIG. 21*c*; 122*d* at FIG. 21*d*; and 122*e* at FIG. 21*e*. Such insulator can be a simple paper member or made of other insulating material positioned or located on the bimetallic plate or element 22 or adhesively or otherwise affixed in assembled position on the associated surface of the bimetallic plate or element 21.

Thus, whether the bimetallic plate 22 is disposed in the thermostat 10 for normally open or normally closed operation, the bimetallic plate or element 22 which is calibrated to respond, as a function of a predetermined temperature, will, on abnormal changes in the ambient temperature, act to engage or disengage the fulcrum member 19 of the leaf spring 16. When this occurs, the movable contact 18 will be brought into or out of engagement with the stationary contact 12 depending on whether the thermostat 10 is designed for normally open or normally closed operation as will be understood by those skilled in the art and all of which is shown by FIGS. 7, 8, 9 and 10 of the drawings.

Thus, with the present invention, there are available at least three mechanisms to increase or decrease the contact pressure to achieve the exact and preferred operating ranges for a given thermal protector. Varying the dimensions and characteristics of the intermediate member 15 and the leaf spring 16 as to material, thickness and design, varying the position of the fulcrum member 19 and its operative contact with the bimetallic plate or element 22, and last, varying the materials, the dimensions, the curvature and other characteristics of the bimetallic plate or element 22.

The bimetallic element 22 controls the operation of thermostat 10 as well as the contact pressure exerted between the movable contact 18 and stationary contact 12 and can take any of a variety of shapes, sizes and thickness. One is illustrated at FIGS. 7, 8, 9 and 10 of the drawings as generally circular in shape and sized to fit into assembled position in the bimetallic chamber or space 21. Other shapes, sizes and thickness can be used for obtaining the desired interengagement with the fulcrum member 19 on the leaf spring 16 for the operating parameters of a given thermal protector without departing from the scope and spirit of the present invention. In addition, the bimetallic element 22 can be made of a corresponding variety of materials so that the shape, size, thickness and material for the bimetallic element provides a wide variety of combinations for establishing the predetermined temperature at which the bimetallic element 21 will operate or snap to actuate the leaf spring 16.

Assembly and Operation of this Embodiment

The operative interrelation of the leaf spring 16, the fulcrum member 19 thereon and the bimetallic element 21 provide a simple mechanism for varying the operating conditions and settings for any of a plurality of thermostats or other types of thermal protectors. More important, the thermal protector in accordance with the present invention permits the precalibrating of the bimetallic element before it is assembled into the thermostat so that it will be responsive to abnormal changes in the ambient temperature conditions which surround the appliance or electrical unit, not shown, being protected.

Further, the assembly of the elements of thermostat 10 does not change this precalibration for the bimetallic plate or element 22 because it is freely positioned or located in assembled position in the thermostat 10.

The bimetallic plate or element 22 as shown in this form of the invention can, but does not have to be, insulated from the current carrying circuit flowing through the thermostat 10. Those skilled in the art will recognize that the bimetallic plate 22 does not form part of the current carrying circuit of the thermostat 10 at any time because the current flows through the less resistant conductive path provided by the other elements of the thermostat 10.

Thus, before the thermostat 10 is assembled, the characteristics of the bimetallic plate or element are determined and the materials, the curvature of the plates, the size, shape and the calibration are established as a function of the ambient temperature range for the given thermostat 10 or thermal protector, in which the bimetallic plate or element 21 will be freely positioned and located to respond to any abnormal changes in this ambient temperature range for the given thermostat or thermal protector.

Next, in order to refine the parameters for the desired range of operation for a given thermostat 10 or thermal protector, the leaf spring 16 of the intermediate element 15 is adjusted by bending or setting the operative position of the leaf spring 16 into the desired relative position and interrelation between the fulcrum member 19 and the bimetallic plate or element 22 and the movable contact 18 relative the stationary contact 12 so that the desired moment of force for the operating range at the given ambient temperature for which the thermostat or thermal protector is set.

When the bimetallic plate or element 22 is in assembled position for either normally open operation as shown in FIG. 9 or normally closed position as shown in FIG. 10, the intermediate member 15 can be clamped to the lower or base terminal member 20 by means of the end clamps 15*a* and 15*b*. Now the upper terminal 11 with the insulating element 13 is nestled into the assembled position on the intermediate member 15, and the vertical section 24*a* and 24*b* can be bent or crimped over the upper terminal 11 to tie, lock and join all the elements together, all of which is shown in FIGS. 1 to 18 of the drawings.

The thermostat 10 is then connected serially into the current carrying line for the appliance or other device, not shown, to be protected, by means of the terminals 12*a* and 23*a*, and the thermostat is ready to operate within the parameters of the bimetallic element 22 as a function of the abnormal changes in the ambient temperature which surrounds the accessory, not shown, to be protected.

If the ambient temperature undergoes an abnormal change which will affect the operation of the particular appliance, not shown, on operation of the bimetallic element 22, the current carrying circuit will open but will reclose during normal recycling of the thermostat 10 where the bimetallic element automatically resets and will close when the ambient temperature conditions reduce. However, the bimetallic element will reopen as soon as the abnormal ambient temperature conditions build up once again, and this will continue until the problem which is causing the abnormal ambient temperature condition is corrected. When this occurs, the bimetallic plate or element 22 will automatically snap back, and normal operation of the appliance can again continue.

Description of Another Embodiment of the Invention

The form of the invention shown in FIGS. 1 to 18 of the drawings is primarily for a wide range of amperage in the current carrying circuit for the particular accessory, not shown, to be protected. However, when the appliance requires high amperage current characteristics, because of the arcing and problems of other high amperage current flow characteristics, the construction may be modified in various ways, for example, as shown in FIG. 19 of the drawings.

In this form of the invention shown in FIG. 19, even though the bimetallic plate or element is not connected into the circuit carrying the high amperage current flow to the accessory being protected, to insure that no arcing or other detrimental conditions occur which might affect the operation of the thermostat 10 or the thermal protector, the bimetallic plate is insulated from the current flowing through the current conducting elements of the thermostat. Such insulation is needed because high currents can damage the bimetallic plate or element. Further, there may be a need to generate additional heat by varying or changing the intermediate element, and the high resistance may generate current which might cause side currents to pass to the bimetallic plate or element. The elements of this form of the invention have substantial similarity to the corresponding elements of the form of the invention first above described. Therefore, where such elements are present, they will not be described in the same detail as was set forth above in the first form of the invention. However, it will be understood that such description is equally applicable to these similar elements as are shown in this form of the invention.

By further reference more particularly to FIG. 19, thermostat 110 is shown to include, a conductive first or upper terminal plate 111 having a stationary contact 112 on the under or inner surface and a first connector 112*a* for connecting the first upper terminal plate 111 into the current carrying circuit of the equipment or accessory, not shown, being protected by the thermostat 110.

Operatively associated with the upper terminal plate 111 is an insulator element 113. The insulator element 113 will fully cover the inner or under surface of the upper terminal plate 111 and has a sized opening 114 therein so that in assembled position the insulator element 113 serves to isolate the upper terminal plate 111 from the remaining current carrying elements of thermostat 110 except for the stationary contact 112 which fits and extends through the sized opening 114 for operative association with the opposite current carrying elements of the thermostat 110. In order to make operative contact with stationary contact 112, an intermediate member 115, made of springlike material of high resistance such as a stainless steel or nickel chrome alloy, has a centrally disposed leaf spring 116 formed or struck therein having a fixed end 117 about which the leaf spring 116 can pivot and a free movable end 117*a* to which a contact 118 is fixedly connected remote from the fixed end, for movement therewith. Contact 118 will thus be movable with the free end of the leaf spring 116 whenever the leaf spring 116 pivots about its fixed end, and will be so positioned on assembly that it will effect contact with the stationary contact 112.

Intermediate member 115 is shown as generally rectangular in plan view and is provided with spaced connecting end clips as at 115*a* and 115*e* for connecting the intermediate member 115 in assembled position as is hereinafter described. The centrally disposed leaf spring 116 in the assembled position as above described will be struck, bent or formed so that the contact 118 movable therewith lies below the horizontal plane of the intermediate member 115. As in the first embodiment this as well as the other forms of the construction as above described are provided to increase the arc of movement and the moment of force produced between the operative elements of the thermostat 110 to insure consistent and accurate operation of the thermostat 110.

Further, in this form of the invention, the fulcrum member 119 is formed by a generally conical insulating member which is formed, affixed or connected by any suitable means, such as an opening 119*a*, a spaced distance medially along the lower face of the leaf spring 116 between the fixed end 117 and the free end 117*a* such that in assembled position it is disposed for non-conducting contact during coaction with the bimetallic plate or element 122 which is freely mounted in non-current conducting association in the second, lower or base terminal plate 120 for the thermostat 110.

Thus, whether the bimetallic plate or element 122 is disposed in thermostat 110 for normally open or normally closed operation, the bimetallic plate or element 122 which is precalibrated for response at a predetermined temperature before it is assembled in the second, lower or base terminal plate 120 will, responsive to an abnormal change in the ambient temperature which surrounds the appliance or electrical unit being protected, not shown, act to engage or disengage the fulcrum member 119 of the leaf spring 116 so that the movable contact 118 will be brought into or out of engagement with the stationary contact 112 or vice versa depending on whether the thermostat 110 is designed for normally open or normally closed operation as will be understood by those skilled in the art.

Second, lower or base terminal plate 120 is also made of any suitable conductive material similar to that above described for the first form of the invention and, as in the first form of the invention, is also fabricated by striking, drawing or molding the plate to a size and shape to permit the lower terminal plate to lock the upper terminal plate 111, its associated insulator element 113, intermediate member 116 and the lower or base terminal plate 120 to each other. When so joined, a space or chamber generally designated 121 is formed between the lower or under surface of the intermediate member 116 and the terminal plate 120 in which the bimetallic element 122 will first be freely positioned or located before these elements of the thermostat 110 are joined to each other, to provide the operative association between the bimetallic plate or element 122 with the leaf spring 116 on the intermediate member 115.

Thus, second, lower or base terminal plate 120 will have a generally horizontal section 123 having a second connector 123*a* for connecting the thermostat 110 to the current carrying circuit of the equipment or accessory being protected by thermostat 110. Spaced vertical sections as at 124*a* and 124*b* are connected to opposite sides of horizontal section 123. The upper surface or inner face of horizontal section 123 and the spaced distance between the vertical sections 124*a* and 124*b* are so shaped and sized that the upper terminal plate 111, its associated insulator element 113 and the intermediate member 115 can be nested and locked into assembled position after the bimetallic element 122 has been freely mounted in the space or chamber 122. These elements of the thermostat 110 are joined or locked together by bending the vertical sections 124*a* and 124*b* about all the elements until the elements are connected together in the same manner as has been above described for the first form of the invention and shown in FIGS. 1 to 18 of the drawings.

The first connector 112*a* on the first or upper terminal plate 112 or the second connector 123*a* on the horizontal section 123 of the second, lower or base terminal plate 120 can be positioned on either end edge of the first or upper terminal plate 112 or the horizontal section 123 of the second, lower or base terminal plate 120 in the same manner as shown by the phantomized lines at FIGS. 9 and 10 of the drawings for the first embodiment of the invention.

Referring to FIG. 19 of the drawings, the inner face of the horizontal section 123 of the second, lower or base terminal plate 120 has a predetermined shaped indented portion which defines the bimetallic chamber or space 121. The bimetallic chamber or space 121 has a generally circular central section 125 and spaced laterally extending side sections 126*a* and 126*b* continuous but on opposite sides of the central circular section 125. The central circular section 125 and the associated side sections 126*a* and 126*b* are so struck, formed or molded that in assembled position these chambers or sections lie below the plane of the horizontal section 123 of the second, lower or base terminal plate 120. The central circular section 125 is wider in diameter than the width of the spaced side sections 126*a* and 126*b* and forms an annular shoulder 127 which is inwardly of the indented rim 127*a* of the circular section 125.

In this form of the invention, when the various elements are tied, locked or joined as above described, the thermostat 110 is provided with an insulating element 128 sized, shaped and formed to fit snugly into the central section 125 and the associated and oppositely spaced side sections 126*a* and 126*b* formed in the second, lower or base terminal plate 120. This insulating element 128 is first positioned, and then the bimetallic plate or element 122 is positioned or located in the insulating element 128, before the upper terminal, insulating member and intermediate member of the thermostat 110 are locked or joined together, by bending or crimping the vertical elements 124*a* and 124*b* of the second or lower base terminal member 120, in the same manner as above described, for the form of the invention shown in FIGS. 1 to 18.

To enable the bimetallic plate or element 122 to be assembled in position with the insulating member 128, the upper face of the insulating member 128 is provided with a plurality of spaced upwardly extending projections on opposite sides as at 129*a*, 129*b*, 129*c*, 129*d* and 129*e* and 130*a*, 130*b*, 130*c*, 130*d* and 130*e* so that the bimetallic plate or element 122 will be caged in the insulating member 128. Thus, when the insulating member 128 and the other elements of the thermostat 110 are assembled and locked together, the bimetallic plate or elements 122 will be disposed for operative coaction with the fulcrum member 119 to actuate and exert the necessary movement of force to move the leaf spring 116 so as to bring contact 118 into and out of engagement with the stationary contact 112 depending on whether the thermostat 110 is designed for normally open or normally closed operation in the same manner as was above described and shown in FIGS. 9 and 10 of the drawings for the first form of the invention.

It should be clear, however, by reason of the insulating member 128, that this form of the invention differs from the first form of the invention above described in that by reason of the insulating member 128 and the insulated fulcrum member 119, no current from the current carrying circuit for the electric motor or other accessory, not shown, in which the thermostat 110 is connected will flow through the bimetallic plate or element 122.

Further, the bimetallic element 122 can be placed or located in the chamber or space in the same manner either as shown in FIG. 9, with the convex side down when normally open operation for the current carrying circuit to be protected is desired, or as shown in FIG. 10, with the convex side up when normally closed operation is desired for the current carrying circuit to be protected.

As in the first form of the invention, the bimetallic element 122 can take any of a variety of shapes, sizes, one such shape being illustrated at FIG. 19 of the drawings as circular in shape and sized to fit into assembled position in the insulating member 128. In addition, the bimetallic element 122 can be made of a corresponding variety of materials for establishing the predetermined temperature at which the bimetallic element 122 will actuate the leaf spring 116.

FIG. 19 shows that in order to further shield and insulate the bimetallic element in this form of the invention, the surface of the bimetallic element 122 disposed for engagement with the fulcrum 119 will have a paper or relatively thin insulator member as at 122' affixed thereto to prevent current flow from the resilient element 116. Further forms of such insulator member are shown at **122*a*, 122*b*, 122*c*, 122*d* and 122*e* in FIGS. 21*a* to 21*e*** inclusive.

Further, the operative interrelation of the leaf spring 116 and the bimetallic plate or element 122 provides a simple mechanism for fine tuning the operating conditions and settings for any of a plurality of thermostats. More important, the thermal protector in accordance with the present invention provides a simple means for precalibrating the bimetallic element before it is assembled into the thermostat, and such precalibration will not be changed during the assembly of the thermostat or thermal protector in accordance with either form of the present invention.

Description of Further Embodiments

In the embodiments above described, the bimetallic plate element 22 for the form of the invention shown at FIGS. 1 to 18 and similarly the bimetallic plate or element 122 for the form of the invention shown in FIG. 19, are self-resetting. Thus, when the abnormal change in the ambient temperature is corrected, the respective bimetallic plates or elements 22 and 122 reset to their regular status for response to the predetermined temperature at which the bimetallic plates or elements will activate.

Figure 23:
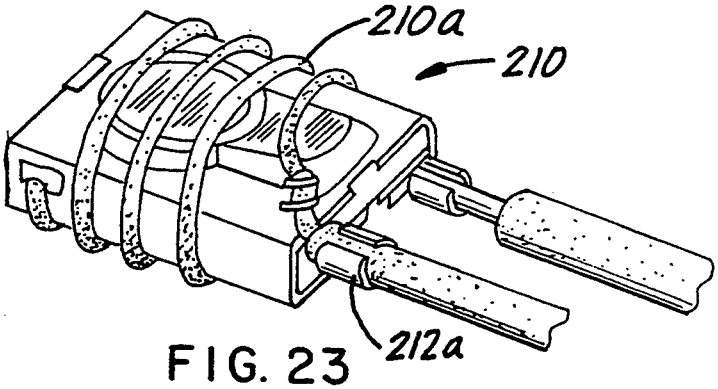
FIG. 23 is a perspective bottom view of the form of thermal protector as shown in FIGS. 1 to 6 of the drawings having a wire wound resistor for adding heat to the thermal protector connected in series with the current carrying circuit.
Figure 24:
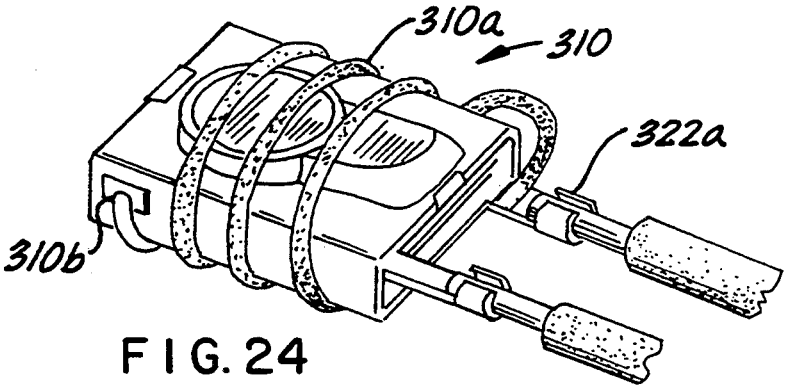
FIG. 24 is a perspective bottom view of the form of thermal protector as shown in FIGS. 1 to 6 of the drawings having a wire wound resistor for adding heat to the thermal protector connected in parallel with the current carrying circuit.

In FIGS. 23 and 24, two embodiments are disclosed using a resistance type heating element to supply or augment heat to maintain the bimetallic element open where necessary to prevent the bimetallic element from resetting too quickly.

Thus, FIG. 23 shows a thermostat generally designated 210 having a heating element **210*a* about the exterior of the thermostat 210 which is connected to one of the current carrying terminals 212*a* for the thermostat 210 so that it is also in series with the current carrying circuit. When the bimetallic plate or element, not shown, for thermostat 210 is in a normally closed position, by choice of the proper resistance of heating element 210*a*, any changes in the amount of current flow will effect the amount of heat generated and absorbed by the housing of thermostat 210. This current monitoring effect, when excessive current is present, will cause the housing to increase in temperature to reach that predetermined temperature at which the bimetallic plate or element, not shown, is actuated, causing it to snap and open the current carrying circuit and thus safeguard the electrical appliance, not shown, being protected by the thermostat 210. However, the casing temperature for the thermostat 210** then begins to fall to the point at which the bimetallic plate or element will reset, causing the circuit to close again and the thermostat will continue to recycle until the problem causing the over-current condition is corrected.

Since current will now pass through the heating element **210*a*, additional heat is generated in the thermostat 210 to prevent the bimetallic element, not shown, for the thermostat 210** from resetting until the abnormal changes in the ambient temperature conditions are corrected.

The embodiment shown in FIG. 24 is for a thermostat 310 in which the bimetallic element, not shown, is in the normally closed position, as shown, at FIG. 10 for the first embodiment of the invention above described.

In this form of the invention the heating element **310*a* is connected at one end to the terminal 322*a* and at the opposite end is in current conductive relation as at 310*b* with the thermostat 310 and therefor is essentially in a current conductive circuit parallel to the thermostat 310. However because of the differential resistance between the thermostat 310 and the bimetallic element or plate, not shown, the current will essentially pass through the thermostat 310 without generating additional heat in the thermostat 310. Heating element 310*a* does not add any supplemental heat until the bimetallic plate or element, not shown, snaps to the open position. Then the heating element which is parallel now will carry current which will raise the temperature of the thermostat 310** to a predetermined level which prevents the bimetallic plate or element from resetting. The reduced amount of heat through current to such low levels prevents the load from functioning and therefore prevents damage from occurring to the electrical appliance, not shown.

Thus, heating element 310 does not add any supplemental heat until the bimetallic element snaps to the open position. Then the heating element, which is in parallel and therefor now will carry current from the current carrying circuit begins to generate supplemental heat to prevent the thermostat 310 from cooling and the bimetallic element from resetting. Once power is removed, the thermostat temperature drops to allow the bimetallic plate or element to reset and the contacts to close. If current is then restored to the current carrying circuit, if the problem is corrected which caused the over-current conditions, the thermostat will remain in the normally closed condition. However, if the problem still exists, the abnormal temperature conditions will rise once again and the bimetallic plate or element will open the current carrying circuit for the electrical appliance being protected.

Though thermal protectors in accordance with the present invention have been described with respect to certain specific embodiments thereof, this has been merely for purposes of illustration, hence many variations and modifications will immediately become apparent to those skilled in the art. Therefore, the scope of the appended claims are intended to include all such variations and modifications.

What is claimed is:

1. A miniaturized thermal protector for protecting an electrical accessory in a current carrying circuit comprising, a. first conductive terminal means connected to the current carrying circuit for the accessory, defines an isolated stationary contact, b. a precalibrated bimetallic element freely positioned in said thermal protector operative in response to abnormal changes in the ambient temperature about said accessory to be protected, c. actuating means including;

i. an intermediate member, ii. resilient means formed on and operable separately from the intermediate member is curved and shaped so that in assembled position it lies in a plane below the plane of the intermediate member, iii. said resilient means having at least one free end and, a contact fixed to said free end and movable with the resilient means is disposed in assembled position for operative coaction with said stationary contact, and iv. fulcrum means on the resilient means disposed for coaction with the bimetallic element for actuation of said resilient means, and d. said bimetallic element and fulcrum means operative on actuation of the resilient means to exert a predetermined moment of force to control the pressure acting between the movable contact and the stationary contact during actuation of the thermal protector.

2. A miniaturized thermal protector for protecting an electrical accessory in a current carrying circuit comprises, a. first conductive terminal means defines a stationary contact and is connected to one side of the current carrying circuit for the accessory, b. actuating means having, resilient means with at least one free end, and a contact fixed to said free end and movable with the resilient means is disposed in assembled position for operative coaction with said stationary contact, c. second conductive terminal means including, sized and spaced side members operating for joining into assembled relationship the first conductive terminal means, the actuating means, and said second conductive terminal means, d. a precalibrated bimetallic element freely positioned in said thermal protector operative in response to abnormal changes in the ambient temperature about said accessory to be protected, and e. said bimetallic element on operation disposed for engagement with said actuating means to move the resilient means and the contact thereon for engagement and disengagement with the stationary contact for opening and closing the current carrying circuit for the electrical accessory to be protected.

3. The thermal protector in claim 2 including, insulator means connected about the first conductive terminal means for isolating all but the stationary contact from the remaining elements of the thermal protector.

4. The thermal protector in claims 2 or 3 wherein the actuating means is made from a material having a low resistance to current flow therethrough.

5. The thermal protector in claims 2 or 3 wherein the actuating means includes, a. an intermediate member disposed between the first conductive terminal means and the second conductive terminal means, and b. the resilient means is formed and shaped to provide a predetermined resistance to the flow of current therethrough when the movable contact thereon is brought into engagement with the stationary contact on actuation by the bimetallic element.

6. A miniaturized thermal protector for protecting an electrical accessory in a current carrying circuit comprising, a. first conductive terminal means connected to the current carrying circuit for the accessory, defines an isolated stationary contact, b. actuating means having, resilient means with at least one free end and, a contact fixed to said free end and movable with the resilient means is disposed in assembled position for operative coaction with said stationary contact, c. second conductive terminal means including, sized and spaced side members operative for joining into assembled relationship the first conductive terminal means, the actuating means, and the said second conductive terminal means, d. a precalibrated bimetallic element freely positioned in said thermal protector operative in response to abnormal changes in the ambient temperature about said accessory to be protected, e. said actuating means including;

i. an intermediate member disposed between the first conductive terminal means and the second conductive terminal means, ii. the resilient means is formed on and operable separately from the intermediate member and is curved and shaped so that in assembled position it lies in a plane below the plane of the intermediate member, and iii. fulcrum means on the resilient means disposed for coaction with the bimetallic element for actuation of said resilient means, and f. said bimetallic element and fulcrum means operative on actuation of the resilient means to exert a predetermined moment of force to control the pressure acting between the movable contact and the stationary contact during actuation of the thermal protector.

7. The thermal protector in claim 6 wherein, the resilient means is formed in the intermediate member with a thickness, width, length and shape to provide a predetermined resistance to the flow of current therethrough when the movable contact thereon is brought into engagement with the stationary contact on actuation of the resilient means by the bimetallic element.

8. The thermal protector in claim 6 wherein the second conductive terminal has an indented section defining a bimetallic space and a side section continuous therewith sloped to form an actuation space to increase the distance the resilient means can travel during actuation of the thermal protector.

9. The thermal protector in claim 6 wherein:

a. the second conductive terminal means has an indented section defining a bimetallic space and a side section continuous therewith and sloped to form an actuation space, b. said bimetallic element freely positioned in the bimetallic space of said indented section of the second conductive terminal means, and c. the resilient means is curved and shaped and positioned in assembled position so that it lies in the actuation space of the indented section of the second conductive terminal means.

10. The thermal protector in claim 9 wherein:

a. the resilient means has a fulcrum means thereon disposed for operative coaction with the bimetallic element to move the resilient means, and b. the resilient means adjustable relative the bimetallic element to control the pressure acting between the movable contact and the stationary contact on actuation of the thermal protector.

11. The thermal protector in claim 9 wherein:

a. said resilient means made of a material and sized shaped and dimensioned to be positioned in the actuation space in the indented section of the second conductive terminal means, and b. fulcrum means medially spaced along the resilient means to adjust the relative movement of the resilient means during coaction with the bimetallic element for controlling the relative force exerted between the movable contact on the resilient means and the stationary contact.

12. The thermal protector in claim 1 wherein:

a. the bimetallic element is automatically resettable, and b. heating means about the thermal protector to prevent the bimetallic element from resetting after the actuation of the actuating means.

13. The thermal protector in claim 12 wherein the heating means is connected to the current carrying circuit in series with the thermal protector.

14. The thermal protector in claim 12 wherein the heating means is connected to the current carrying circuit in parallel with the thermal protector and is operative after the bimetallic element moves from the normally closed position to an open position.

15. A miniaturized thermal protector for protecting an electrical accessory in a current carrying circuit comprises, a. first conductive terminal means defining, a stationary contact, and having a connecting means for connecting said first terminal means to one side of the current carrying circuit, b. insulator means positioned relative to said first terminal means for isolating all but the stationary contact thereon from the other side of said current carrying circuit, c. a conductive actuating means having, contact faxed to said free end and movable therewith disposed in assembled position for operative association with the stationary contact, d. second terminal means having a connector thereon for connecting the second terminal means to the opposite side of said current carrying circuit includes, means for locking into assembled relationship the first terminal means, its associated insulator means, the actuating means and said second terminal means, e. a bimetallic element freely mounted in said second terminal means calibrated for snap action at a predetermined temperature, f. said bimetallic element operative to actuate the resilient means and the contact thereon for engagement and disengagement with the stationary contact responsive to abnormal changes in the ambient temperature about the accessory for opening and closing the current carrying circuit for the electrical accessory to be protected, and g. means on the actuating means for connecting the actuating means in assembled position in the thermal protector.

* * * * *

UNITED STATES PATENT AND TRADEMARK OFFICE

CERTIFICATE OF CORRECTION

PATENT NO. : 5,337,036

DATED : August 9, 1994

INVENTOR(S) : Robert A. Kuczynski

It is certified that error appears in the above-indentified patent and that said Letters Patent is hereby corrected as shown below:

Column 11, line 1, "115a" should read --115d--.
Column 18, line 15, after "having," insert --a--.
Column 18, line 16, "faxed" should read --fixed--.

Signed and Sealed this

Twenty-third Day of May, 1995

*Attest:*

Bruce Lehman

BRUCE LEHMAN

*Attesting Officer*

*Commissioner of Patents and Trademarks*